United States Patent [19]

Carlson et al.

[11] 4,003,827

[45] Jan. 18, 1977

[54] MERCAPTAN CONVERSION PROCESS FOR A PETROLEUM DISTILLATE CHARGE STOCK

[75] Inventors: David H. J. Carlson, Park Ridge; Peter Urban, Northbrook, both of Ill.

[73] Assignee: Universal Oil Products Company, Des Plaines, Ill.

[22] Filed: June 12, 1975

[21] Appl. No.: 590,525

[52] U.S. Cl. ..... 208/206

[51] Int. Cl.[2] ..... C10G 19/00

[58] Field of Search ..... 208/206, 207

[56] References Cited

UNITED STATES PATENTS

| | | | |
|---|---|---|---|
| 2,882,224 | 4/1959 | Gleim et al. | 208/207 |
| 2,966,453 | 12/1960 | Gleim et al. | 208/207 |
| 3,398,086 | 8/1968 | Rosenwald et al. | 208/206 |
| 3,408,287 | 10/1968 | Urban et al. | 208/207 |

*Primary Examiner*—Earl C. Thomas
*Assistant Examiner*—Wayne A. Langel
*Attorney, Agent, or Firm*—James R. Hoatson, Jr.; Raymond H. Nelson; William H. Page, II

[57] ABSTRACT

A process is disclosed for the conversion of a petroleum distillate charge stock containing mercaptan, olefinic and dienic compounds comprising the treatment of said petroleum distillate in an atmosphere of an oxygen-containing gas in a medium possessing a pH of from about a pH of 8 to about a pH of 14 in the presence of a catalyst comprising a 4,4',4'',4'''-cobalt phthalocyanine tetrasulfonate.

14 Claims, No Drawings

MERCAPTAN CONVERSION PROCESS FOR A PETROLEUM DISTILLATE CHARGE STOCK

This invention relates to a process for the conversion of mercaptan-containing compounds in a petroleum distillate charge stock. More specifically, this invention relates to the conversion of a petroleum distillate charge stock containing mercaptan, olefinic and dienic compounds comprising the treatment of said petroleum distillate in an atmosphere of an oxygen-containing gas in a medium possessing of from about a pH of 8 to about a pH of 14 in the presence of a catalyst comprising a 4,4',4'',4'''-cobalt phthalocyanine tetrasulfonate.

The art of mercaptan conversion in petroleum distillates is well known in prior treatment art. For example, it is well known that a gasoline charge stock containing various mercaptan compounds may be treated using metal phthalocyanine compounds for the conversion of the mercaptan compounds contained in the gasoline charge stock to disulfide compounds. The necessity of the conversion of the mercaptan compounds in a petroleum distillate charge stock is as a result of the bad odor of the mercaptan compounds which necessitate conversion to a "doctor-sweet" product. The easiest means of conversion known to the art is by means of the oxidation of the mercaptan compounds to disulfide compounds. The difficulty of converting the mercaptan compounds will depend on which mercaptan compounds are present in the petroleum distillate charge stock. In lighter charge stocks such as a straight run gasoline the mercaptans comprise lower alkyl mercaptans which are fairly easily oxidized by any of the metal phthalocyanine catalysts known to the art. However, as the complexity of the blend of the charge stock increases the complexity of the different mercaptan compounds will increase and therefore the degree of difficulty of conversion also becomes greater. Petroleum distillate charge stocks which are high in mercaptan, olefinic and dienic compound content such as an FCC gasoline charge stock will contain very difficult to convert mercaptans such as aromatic mercaptans or branched chained alkyl mercaptans such as dodecyl mercaptan. It is known as a problem of mercaptan treating or conversion that certain FCC gasoline charge stocks possess unconvertible mercaptan compounds in the presence of certain catalytic compositions of matter. For example, it is known that a mercaptan-containing FCC gasoline charge stock is very difficult to convert to a sweet or substantially mercaptan-free FCC charge stock in the presence of 4,4'-cobalt phthalocyanine disulfonate.

In contradistinction to the prior art it has now been discovered that mercaptans found in an FCC gasoline charge stock may be converted to disulfides by treatment in an atmosphere of an oxygen-containing gas in a medium possessing a pH of from about a pH of 8 to about a pH of 14 in the presence of a catalyst comprising 4,4',4'',4'''-cobalt phthalocyanine tetrasulfonate. The utilization of the above set forth invention will allow the operator of fluid catalytic cracking units to obtain a doctor sweet reactor effluent as a result of conversion of the until now very difficult to convert mercaptan materials present in the FCC gasoline charge stock effluent. The utilization of this invention will also allow the manufacturer or refiner a more ecologically feasible method for the preparation of petroleum distillates which are high in dienic and olefinic compound content as a result of the elimination of harmful and bad odorous compounds.

The utilization of the present invention is set forth in the ability of the process of the present invention to take a foul or sour petroleum distillate such as an FCC gasoline charge stock and treat said stream to a doctor sweet effluent for the betterment of the refiner and the ecology.

It is therefore an object of this invention to provide a process for the conversion of mercaptan compounds in a petroleum distillate charge stock containing high mercaptan, dienic and olefinic compound content.

Further, it is an object of this invention to provide a process for the conversion of mercaptan compounds in an FCC gasoline charge stock utilizing a composition of matter which will better effect the mercaptan conversion to disulfides.

In one aspect an embodiment of this invention resides in a process for the conversion of a petroleum distillate charge stock containing mercaptan, olefinic and dienic compounds comprising the treatment of said petroleum distillate in an atmosphere of an oxygen-containing gas in a medium possessing a pH of from about a pH of 8 to about a pH of 14 in the presence of a catalyst comprising a 4,4',4'',4'''-cobalt phthalocyanine tetrasulfonate at treatment conditions and recovering the resultant treated charge stock.

A specific embodiment of this invention resides in a process for the treatment of an FCC gasoline charge stock containing 240 parts per million mercaptan in said charge stock in the presence of air, a sodium hydroxide medium possessing a pH of about 11 and a catalyst dissolved in said medium comprising 4,4',4'',-4'''-cobalt phthalocyanine tetrasulfonate at a temperature of 25° C. and a pressure of 1 atmosphere and recovering the resultant treated FCC gasoline charge stock after a period of time comprising 4 minutes.

Other objects and embodiments of the hereinbefore set forth invention will be discussed in the following further detailed description of the present invention.

As hereinbefore set forth the present invention is concerned with the treatment of a petroleum distillate charge stock containing mercaptan, olefinic and dienic compounds comprising the treatment of said charge stock in an atmosphere of an oxygen-containing gas in a medium possessing a pH of from about 8 to about a pH of about 14 in the presence of a catalyst comprising a 4,4',4'',4'''-cobalt phthalocyanine tetrasulfonate at treatment conditions. The treatment conditions will include a temperature of from about 15° C. to about 300° C. and a pressure of about 1 atmosphere to about 100 atmospheres. When atmospheric pressures afforded in the process of this invention are superatmospheric pressures they may be afforded by the introduction of the oxygen-containing gas to the treatment zone or, if desired, any substantially inert gas may be intermixed with the oxygen-containing gas to afford the total pressure of the system whereby the partial pressure of the system is equal in sum to the total pressure of the treatment system. Suitable oxygen-containing gases will include oxygen, oxygen-nitrogen mixtures (air), oxygen-xenon mixtures, oxygen-nitrogen-helium mixtures, oxygen-helium mixtures, oxygen-argon-krypton, etc.

The charge stock of this invention is defined as a petroleum distillate containing mercaptan, olefinic and dienic compounds. The quantity of the mercaptan compounds will range from 20 ppm mercaptan as sulfur to about 1000 ppm mercaptan as sulfur. The diene content of the petroleum distillate of the present invention will range from 0.5 grams of dienic compounds to about 3.5 grams of dienic compounds as determined by the grams of iodine per 100 grams of petroleum distillate. The olefinic compounds will range from about 20.0 grams to about 70.0 grams of olefinic material as determined by the grams of bromine per 100 grams of petroleum distillate. A suitable example of the petroleum distillate will comprise an FCC gasoline petroleum distillate. It is known in the art of catalytic cracking of gasoline that FCC gasoline petroleum distillates possess different chemical properties depending on such factors as the original charge stock ingressed to the FCC unit, the catalytic composition of matter within the FCC unit and the method of performing the catalytic cracking of the original charge stock. It is contemplated within the scope of this invention that any gasoline derived from an FCC unit may be utilized as the petroleum distillate charge stock. The mercaptan content of FCC gasoline petroleum distillates is usually one that is aromatic in nature such as thiophenol. The mercaptan content may also be aliphatic in nature such as methyl mercaptan, ethyl mercaptan, propyl mercaptan, butyl mercaptan, amyl mercaptan, hexyl mercaptan, heptyl mercaptan, nonyl mercaptan, decyl mercaptan, or other various straight chained aliphatic mercaptan compounds containing from about 1 to about 20 carbon atoms. The mercaptan-content of the FCC gasoline petroleum distillate may also comprise branched-chain aliphatic mercaptan compound such as dodecyl mercaptan or other various hard to treat mercaptan compounds. The thiophenolic mercaptan compounds may be substituted with other substituents such as alkyl, carboxyl, alkoxy, aryl, alkaryl, aralkyl or alcoholic moieties.

The catalytic composition of matter of the present invention will comprise a 4,4',4'',4'''-cobalt phthalocyanine tetrasulfonate compound. This compound is known in the art to be made by various methods of catalyst manufacture. One such method of catalyst manufacture is the reaction of triammonium sulfophthalate with urea and cobalt sulfate heptahydrate in the presence of boric acid. It is contemplated within the scope of this invention that the catalytic composition of matter may be present in the form of a liquid-liquid two phase petroleum distillate charge stock-4,4',4'',4'''-cobalt phthalocyanine tetrasulfonate system. The liquid-liquid system is defined as having two phases one of which is the petroleum distillate charge stock containing mercaptan, olefinic and dienic compounds and the second of which is the cobalt phthalocyanine tetrasulfonated catalyst which may be present in a reaction medium which is liquid in nature and possesses a pH of from about a pH of 8 to about a pH of 14. The conversion of the mercaptan compounds in the liquid-liquid system will be effected at the interface of the two systems on the basis of contact with the catalytic compositions of matter. The reaction medium of the liquid-liquid system will comprise any alkaline material such as sodium hydroxide, potassium hydroxide, lithium hydroxide, rubidium hydroxide, cesium hydroxide, barium hydroxide, strontium hydroxide, calcium hydroxide, magnesium hydroxide, beryllium hydroxide, ammonia hydroxide, pyridine, piperidine, picoline, lutidine, quinoline, pyrrole, indole, carbazole, acridine or any suitable quaternary ammonia compounds such as tetrabutyl ammonium hydroxide, tetraamyl ammonium hydroxide, tetrapropyl ammonium methoxide, tetraamyl ammonium methoxide, tetraethyl ammonium ethoxide, diethyl amine, triethyl amine, tetramethylenediamine, tetraethylenepentamine, phenylenediamine, however, the pH in the reaction medium will range from about a pH of 8 to a pH of about 14 or more preferably a pH of from about 9 to about a pH of 11.

In a preferred embodiment of the present invention the catalyst system of the present invention will also comprise a catalyst system which may be present as a fixed bed system. The fixed bed system of catalytic treatment is well known in the art and it is contemplated within the present invention that the 4,4',4'',4'λ''-cobalt phthalocyanine tetrasulfonate is dispersed on the fixed bed. The fixed bed will comprise any solid material such as alumina, silica, magnesia, thallia, zirconia, carbon, charcoal, γ - alumina, mordenite, faujasite, pumice, etc.

The 4,4',4'',4'''-cobalt phthalocyanine tetrasulfonate may be present in the total catalyst system in a weight percent relative to the entire reaction system of from about .0001 weight percent to about 10.00 weight percent. The aforementioned weight percentages are applicable to both the fixed treating system and the liquid-liquid two phase petroleum distillate charge stock-4,4',4'',4'''-cobalt phthalocyanine tetrasulfonate system.

The resultant treated charge stock will comprise a petroleum distillate charge stock containing substantially the same quantity of olefinic and dienic material but a greatly reduced mercaptan content. The mercaptan compounds are converted to disulfide compounds to the extent that the resultant petroleum distillate is substantially free of mercaptan compounds. The remaining quantity of mercaptan compounds will be small enough to qualify the petroleum distillate as a doctor sweet petroleum distillate. The term doctor sweet is relative to the type of analysis to determine mercaptan content but will range from about 5 ppm mercaptan as sulfur in gasoline to about 20 ppm mercaptan as sulfur in kerosene petroleum distillates.

It is understood that the aforementioned mercaptan, catalytic systems and fixed beds are only representative of the class of compounds which may be employed in the present invention and the present invention is not limited thereto.

The following examples are introduced to illustrate the further novelty and utility of the present invention but not with the intention of unduly limiting the same.

EXAMPLE I

This example was effected for the purpose of comparing the treatment of an FCC gasoline charge stock utilizing a disulfonated cobalt phthalocyanine compound in contrast to the treatment of a catalyst comprising a cobalt phthalocyanine tetrasulfonated compound of Example II. The unexpected results of the present invention may be viewed from the increased conversion of the mercaptan compounds of Example II in the presence of the tetrasulfonated compound over a shorter period of time in contradistinction to the limited conversion of the mercaptan compounds in the presence of the disulfonated compound of Example I. The disulfonated cobalt phthalocyanine compound was prepared and analyzed and found to contain a spectrum of the sulfonated derivatives as set forth in Table I below

TABLE I

| ISOMER | WEIGHT PERCENT |
|---|---|
| Monosulfonate | 6.3 |
| Disulfonate | 59.6 |
| Trisulfonate | 25.6 |
| Tetrasulfonate | 8.5 |
| | 100.0 |

This aforementioned catalyst was used to treat an FCC gasoline charge stock in a reaction medium comprising 10° Be caustic of sodium hydroxide over a period of time comprising 8 minutes in the presence at a temperature of 25° C. and a pressure of 1 atmosphere. The relative mercaptan content over the 8 minute period of time is set forth in Table II

TABLE II

| TIME | WT.-PPM MERCAPTAN |
|---|---|
| 0 | 240 |
| 2 | 25 |
| 4 | 23 |
| 6 | 15 |
| | Doctor Sweet |
| 8 | 4 |

EXAMPLE II

In this example a tetrasulfonated catalyst was prepared and analyzed and found to contain 100% tetrasulfonate isomer of cobalt phthalocyanine tetrasulfonate. This catalyst was used in the treatment of a similar aliquot portion of the FCC gasoline charge stock utilized in Example I in the presence of the same reaction medium comprising sodium hydroxide and in the presence of the same quantity of air and reaction temperature and pressure. The results of the mercaptan sweetening process are set forth in Table III below

TABLE III

| TIME | WT.-PPM MERCAPTAN |
|---|---|
| 0 | 240 |
| 2 | 13 |
| 4 | 2 Doctor sweet |
| 6 | <1 |
| 8 | <1 |

A comparison of Example II with Example I in the treatment of the same charge stock will show the unexpected results of the present invention. In Example I the mercaptan content after the 4 minute period of time was 23 parts per million in comparison with the 2 parts per million mercaptan content of the tetrasulfonated catalyst treatment process of Example II. It can also be seen that it required between 6 to 8 minutes in Example I to render a doctor sweet product where in the Example II utilizing the tetrasulfonated cobalt phthalocyanine derivative the doctor sweet product was formed somewhere between 2 and 4 minutes.

EXAMPLE III

In this example a FCC gasoline charge stock containing mercaptans, olefins and dienes is treated in a medium comprising sodium hydroxide and air in a fixed bed method of treatment which comprises the passage at a LHSV of 3.0 of the FCC gasoline mercaptan-containing charge stock over a fixed bed of 4,4',4'',4'''-cobalt phthalocyanine tetrasulfonate dispersed on γ-alumina. The treatment is effected at a treatment temperature of 100° C. and a pressure of 5 atmospheres as afforded by the introduction of the air to the reaction system. The FCC gasoline charge stock is recovered subsequent to the fixed bed and analyzed for mercaptan content, said mercaptan content analysis showing a doctor sweet FCC gasoline.

We claim as our invention:

1. A process for the substantially complete conversion of mercaptan compounds to disulfide compounds in a petroleum distillate which comprises treatment of said distillate at a temperature of from about 15° C. to about 300° C. and a pressure of from about 1 atmosphere to about 100 atmospheres in an oxygen containing atmosphere and a medium possessing a pH of from about 8 to 14 in the presence of a catalyst consisting essentially of 4,4',4'',4'''-cobalt phthalocyanine tetrasulfonate.

2. The process of claim 1 wherein the mercaptan-containing compounds comprise aromatic mercaptans.

3. The process of claim 2 wherein the aromatic mercaptans are thiophenols.

4. The process of claim 1 wherein the treatment is effected in the presence of a fixed bed system.

5. The process of claim 4 wherein the fixed bed consists essentially of 4,4',4'',4'''-cobalt phthalocyanine dispersed on γ-alumina.

6. The process of claim 4 wherein the fixed bed consists essentially of 4,4',4'',4'''-cobalt phthalocyanine dispersed on silica.

7. The process of claim 4 wherein the fixed bed consists essentially of 4,4',4'',4'''-cobalt phthalocyanine dispersed on charcoal.

8. The process of claim 4 wherein the fixed bed consists essentially of 4,4',4'',4'''-cobalt phthalocyanine dispersed on magnesia.

9. The process of claim 4 wherein the fixed bed consists essentially of 4,4',4'',4'''-cobalt phthalocyanine dispersed on pumice.

10. The process of claim 4 wherein the fixed bed consists essentially of 4,4',4'',4'''-cobalt phthalocyanine dispersed on mordenite.

11. The process of claim 1 wherein the oxygen-containing atmosphere consists essentially of oxygen.

12. The process of claim 1 wherein the oxygen-containing atmosphere comprises air.

13. The process of claim 1 wherein the petroleum distillate charge stock is an FCC gasoline.

14. The process of claim 1 wherein the treatment is effected in a liquid-liquid two phase petroleum distillate charge stock-4,4',4'',4'''-cobalt phthalocyanine tetrasulfonate system.

* * * * *